US005681445A

United States Patent [19]

Harrison et al.

[11] Patent Number: 5,681,445

[45] Date of Patent: Oct. 28, 1997

[54] MODIFIED SURFACE BIPOLAR ELECTRODE

[75] Inventors: Stephen Harrison, Shawinigan, Canada; Robert L. Clarke, Orinda, Calif.; Robert Scannell; Bernd Busse, both of Darmstadt, Germany

[73] Assignee: Hydro-Quebec, Montreal, Canada

[21] Appl. No.: 575,989

[22] Filed: Dec. 21, 1995

[51] Int. Cl.[6] ..... C25B 11/06

[52] U.S. Cl. ..... 205/445; 205/457; 204/290 F; 204/290 R

[58] Field of Search ..... 204/290 F, 290 R; 205/445, 457, 464, 477

[56] References Cited

U.S. PATENT DOCUMENTS

| | | | |
|---|---|---|---|
| 3,402,117 | 9/1968 | Evans | 204/290 F |
| 3,880,721 | 4/1975 | Littauer | 205/149 |
| 4,313,804 | 2/1982 | Oehr . | |
| 4,422,917 | 12/1983 | Hayfield | 204/196 |
| 4,530,745 | 7/1985 | Komatsu | 205/687 |
| 4,708,888 | 11/1987 | Mitchell | 427/126.1 |
| 4,794,172 | 12/1988 | Kreh | 534/15 |
| 4,936,970 | 6/1990 | Weinberg et al. | 204/242 |
| 4,971,666 | 11/1990 | Weinberg et al. . | |
| 5,296,107 | 3/1994 | Harrison | 205/447 |

*Primary Examiner*—John Niebling
*Assistant Examiner*—Brendan Mee
*Attorney, Agent, or Firm*—Limbach & Limbach

[57] ABSTRACT

A bipolar electrode useful in bipolar cell stack electrochemical cells where one of the electrode surfaces is patterned with active and relatively inactive areas where the surface area ratio of the active areas of the electrode surface to the total electrode surface is between 1:2 and 1:50. The use of a grid-like pattern of electrocatalytic material over a conductive substrate is preferred. The electrodes can be used for certain redox reactions to favor particular reaction products.

33 Claims, 2 Drawing Sheets

MODIFIED SURFACE BIPOLAR ELECTRODE

BACKGROUND OF THE INVENTION

1. Field of the Invention

The present invention relates to a bipolar stack electrode having a patterned surface as a means for favoring the electrochemical reaction products formed at either the cathode or anode surfaces of the bipolar stack electrode.

2. Description of Prior Art

Electrochemical reactions are conducted in reactors where a direct electrical current is passed through an electrolyte from the cathode to the anode. Oxidation reactions occur at the cathode where the reactive species accepts electrons.

Some electrochemical reactions produce anodic or cathodic products and/or utilize reactants that need to be separated during the electrolysis process to avoid unwanted back or side reactions.

In other instances, the products of an electrochemical reaction are in equilibrium with each other. For example, the electrolysis of cerous/ceric sulfate mixtures involves two competing reactions with an equilibrium constant near 1.

[Cathodic product] $Ce^{+3} \leftrightarrow Ce^{+4}$ [Anodic product] In a divided cell, either product can be selectively produced depending on whether the starting materials are placed in the anodic or cathodic chamber.

$Ce^{+3} \leftrightarrow Ce^{+4}$ at the anode $Ce^{+4} \leftrightarrow Ce^{+3}$ at the cathode Divided electrochemical cells have several disadvantages compared to undivided electrochemical cells. Divided cells are more complicated since they require the use of two electrolyte streams, a cathodic electrolyte stream and an anodic electrolyte stream. In contrast, an undivided cell requires only one electrolyte stream. In addition, membranes or diaphragms must be employed in a divided cell to separate the two compartments. These membranes and diaphragms can be expensive and troublesome to use, thereby increasing both the operating costs and the amount of operation downtime accrued. The use of membranes and diaphragms also increases the electrical resistance of the electrochemical cell. This further directly increases the cost of the cell operation and the overall electrochemical efficiency of the cell.

In the light of these problems, it would be highly desirable to develop an electrochemical cell which has the ability to drive the equilibrium of a reaction in one direction while preventing reaction products from interfering with each other.

Various cell designs and methods have been developed which favor the formation of an anodic or cathodic reaction product in an undivided cell in order to mimic the selectivity advantages of divided electrochemical cells. One method and cell type for favoring either the anodic or cathodic reaction product involves the use of anodes and cathodes having significantly different surface areas. For example, Oehr, et al., U.S. Pat. No. 4,313,804 uses a thin wire cathode in combination with a large diameter tube anode in order to favor the anodic reaction.

By using this combination of electrodes, Oehr, et al create conditions which favor the anodic reaction at the expense of the unwanted cathodic reaction. The process works by reducing the access of $Ce^{4+}$ ions to the reducing cathode by making the cathode very small with respect to the anode. Electrochemical processes are promoted by improving mass transfer of reagents to the electrode surface. Thus, a large area of electrode for a given current improves the mass transfer of the reaction and facilitates the electrochemical reaction. Conversely reducing the surface area of an electrode hinders mass transfer and thus slows the electrochemical reaction. The wire and tube electrode system taught by Oehr, et al. creates a large inter-electrode gap which creates a larger IR drop through the electrolyte, thereby increasing the overall energy consumption. Further, "wire" electrodes result in a cell design which is not suitable for bipolar operation. Tube cell configurations are difficult to scale up to industrial sized electrolysers as compared to parallel plate or filter press type electrolyser.

Heavy industrial electrolysers used in large scale manufacture of chlor-alkali products use parallel plate reactors because they provide better current distribution, narrow cell gaps and easily engineered high mass transport. This invention is concerned with adapting a successful strategy for undivided cell operation to this preferred cell design.

Ibl. J. Applied Electrochem (1968) 115:713 teaches a method for promoting either the anodic or cathodic reaction in an undivided cell while, at the same time, inhibiting the back reaction at the opposite electrode. Ibl's method involves placing a porous felt barrier across the face of the electrode to be deactivated. The porous barrier serves to inhibit the replenishment of reagent ions from the bulk of the solution, thereby limiting their oxidation or reduction. This strategy can be applied to parallel plate reactors. However, uneven current distribution and blockage due to the formation of large bubbles can occur. The bubbles are formed by the gassing reactions which are promoted when redox ions are reduced to low concentrations. In some cases, the distortion of the pH at the electrode creates deposits within the electrode barrier interfering with its performance.

A third method for favoring the formation of either the anodic or cathodic reaction products involves the use of one electrode material which is an efficient oxidizer while the counter electrode is made of a material possessing a poor ability to reconvert the product produced at the first electrode, as is taught, for example, in U.S. Pat. Nos. 4,936,970 and 4,971,666.

SUMMARY OF THE INVENTION

The present invention relates to a bipolar electrode useful in bipolar stack electrochemical cells. In order to avoid the deficiencies of the prior art in undivided cells of unequal anode/cathode surface areas, one of the faces of the bipolar electrode is patterned in a special manner, reducing the available surface area. In one embodiment, electrocatalytically active material is applied in a manner that distributes the active areas in a carefully engineered pattern that provides excellent current distribution, but over a much reduced area. In another embodiment, one face of a bipolar electrode is masked in such a manner that the electrochemically active electrode surface is exposed in a pattern. In all embodiments, it is preferred that the surface area ratio of the electrocatalytically active areas or exposed electrode areas of the electrode surface to the total area of the other electrode surface is between 1:2 to 1:50.

In a broad aspect, the invention relates to a bipolar electrode, said electrode comprising an electrically conductive substrate, said substrate having opposed electrode surfaces, one of said faces including a pattern of linear ridges of electrocatalytic material, wherein the ratio of the area covered by said electrocatalytic material to the total area of the patterned electrode face is in a range of from 1:2 to 1:50.

According to another broad aspect, the invention relates to a method for converting $Ce^{+4}$ to $Ce^{+3}$ comprising contacting $Ce^{+4}$ with a bipolar electrode wherein the bipolar electrode comprises an electrically conductive substrate, said substrate having opposed electrode surfaces, one of said faces including a pattern of linear ridges of electrocatalytic material, wherein the ratio of the area covered by said electrocatalytic material to the total area of the patterned electrode face is in a range of from 1:2 to 1:50.

BRIEF DESCRIPTION OF DRAWINGS

The invention will be better understood by reference to the appended figures in which.

DESCRIPTION OF PREFERRED EMBODIMENTS

Figure 1A:
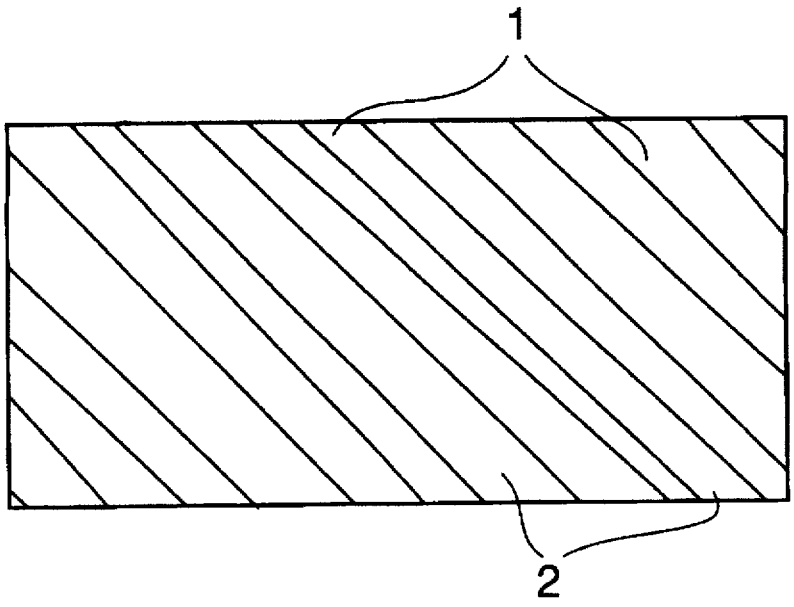
FIGS. 1*a* and 1*b* depict preferred patterns of electrocatalytically or electrochemically active areas on one face of a bipolar electrode.

The present invention relates to a bipolar electrode having either an anodic or cathodic patterned surface, wherein the electrode is useful in bipolar cell stack type electrochemical cells. In a first embodiment, the patterned electrodes of the present invention are comprised of electrocatalytically active regions set out in a grid-like pattern. In this form, the grid-like pattern used produces a surface area ratio of the electrocatalytically active areas of the electrode surface to total area of the electrode surface of between 1:2 to 1:50 without disturbing the efficiency of the anode face in the attached bipole. This is an important result. The transfer of the effects of the pattern through the bipole material that would create areas of high and low activity on the attached bipolar anode would reduce the efficacy of the system.

In the prior art, based on the geometrical arrangement of bipolar cell stack electrochemical cells, the anodic and cathodic surfaces necessarily have the same total surface areas. Therefore, it is not possible to use anodes and cathodes with disproportionate surface areas in a bipolar cell stack. Further, reduction of the surface area of either the anode would be disadvantageous because of the large diffusion barriers created. The grid-like pattern used in the present invention does not create these large diffusion barriers.

By using a pattern on the electrode, the invention also avoids the electrochemical inefficiencies associated with employing an electrode composed of inhibited, deactivated or inactive electrode materials. While a grid-type pattern is preferred, those skilled in the art will understand that any pattern of linear ridges which provides for an overall relatively uniform distribution of active areas over the patterned surface will provide the same advantages. For example, concentric circle or "checkerboard" patterns might be used. In any case, applicants intend the term "patterned" as used herein to include any manner of creating active areas relatively uniformly, i.e. evenly spaced, over the surface of the electrode.

The present invention is advantageously used with materials that possess certain physical qualities. The bipolar electrodes of the present invention must be composed of a substance capable of tolerating anodic and cathodic polarization. The electrode material must also be nonporous in order to prevent the permeation of electrolyte from one compartment of the cell stack to another. The electrode material is also preferably composed of a material that is chemically resistant to the corrosive effects of electrolytes and should prevent protons from permeating through the electrode material.

Suitable electrode materials include conductive ceramics, precious metals and metal oxides. Titanium and niobium, electrode materials well known in the electrochemical art, can be used. The Magneli phase titanium oxide ceramics described in U.S. Pat. No. 4,422,917 may also be used. These ceramics are preferred because of their conductivity and relatively inert qualities in many corrosive electrolytes. As shown in the examples below, these ceramics also provide the electrodes of the present invention with good current distribution over the entire electrode surface.

The patterned surface may be created on one of the electrode surfaces in any manner which achieves the required pattern. For example, the electrode surface can be patterned by first coating the entire surface of the electrode with an electrochemically inactive film of material that is also resistant to the corrosive effects of most electrolytes, such as polyfluorocarbon polymers. Such a film may be applied to the electrode surface in the form of a perfluoroether paint. Upon evaporation of the solvent, the polyfluorocarbon polymer forms an electrochemically inactive film that effectively shields the entire electrode surface. Active areas in the form of the grid pattern are created by either masking the electrode with a stencil prior to coating with the perfluoropolymer paint or removing areas of the painted film with a hard stylus.

Alternatively, for certain electrode materials such a titanium suboxides, relatively inactive (i.e. non conductive) areas can be created by exposing those areas to high temperature to convert the suboxide to non-conductive titanium dioxide, for example, using laser light or a flame torch with fine attenuated flame front. Areas touched by heat above 600° C. are rapidly converted to inert titanium dioxide.

Where it is preferred to use a pattern of electrocatalytically active material, such material can be applied by a variety of known methods which include, but are not limited to, the use of vacuum sputtered deposition of platinum or other electrocatalysts as well as other conventional electrocatalyst deposition techniques. The electrocatalyst, such as platinic chloride or mixed titanium-iridium organo metallic compounds in a pentanol solvent, can be applied as a paint where the carrier solvent is subsequently evaporated away. The organo metallic compound is then fired at 350°–450° C. to convert it to a mixed metal oxide form. Another method for forming the electrocatalyst includes vapor phase deposition of the electrocatalyst using a mask or template. As a practical matter, this would give rise to the need for recycling the material deposited on the template. Some electrocatalysts can. be applied as electroplated films, platinum, lead dioxide, manganese dioxide, nickel and lead for example. It is a simple matter to mask the substrate prior to electroplating with conventional resistive waxes and paints in a mesh type pattern which creates the desired effect when the plating process is complete.

Where polymer coating is used, reactivation of portions of the polymer coated electrode surface may be accomplished by scraping away the film from the face of the electrode in the desired pattern, or eroding the film away with a high pressure water jet or tuned laser.

FIG. 1*a* shows a grid-like pattern of electrochemically active lines 1 and non-patterned regions 2 on the electrode surface. In one embodiment, regions 2 are masked and active lines 1 are exposed electrode surface. In another embodiment regions 2 are exposed electrode surface and lines 1 are electrocatalytically active material layered onto the electrode surface. The pattern is preferably arranged so that the lines 1 are no more than a few millimeters apart and less than one millimeter in width. This pattern is used to ensure that the electrochemical activity is spread across the face of the electrode in a manner that does not disturb the current distribution on the back side of the bipole. Current distribution distortions on the anode that reduce the cell's current efficiency are observed if the separation between electrocatalytically active regions is too great. The patterns disclosed in FIGS. 1*a* and 1*b* also serve to distribute the electrochemically active regions over a wider area, thus avoiding the diffusion barriers observed when the surface area of a disfavored electrode is merely reduced.

The preferred surface area ratio of the active areas of the electrodes to the total surface area of the electrode is between 1:2 and 1:50 (by total surface it is meant only the total surface of one electrode side, i.e. the total cathode or total anode surface, not both sides of the bipole). The most preferred surface area ratios are between 1:6 and 1:12. However, within these ranges the precise surface area ratio for a particular electrochemical reaction to be carried out can readily be determined by the skilled worker.

The performance of the bipolar electrode of the present invention is illustrated by the following examples. Further objectives and advantages other than those set forth above will become apparent from the examples and accompanying drawings. The examples show the use of the invention with respect to electrochemical regeneration of ceric oxidants, a particularly advantageous application of the invention.

EXAMPLES

Example 1

Figure 1B:
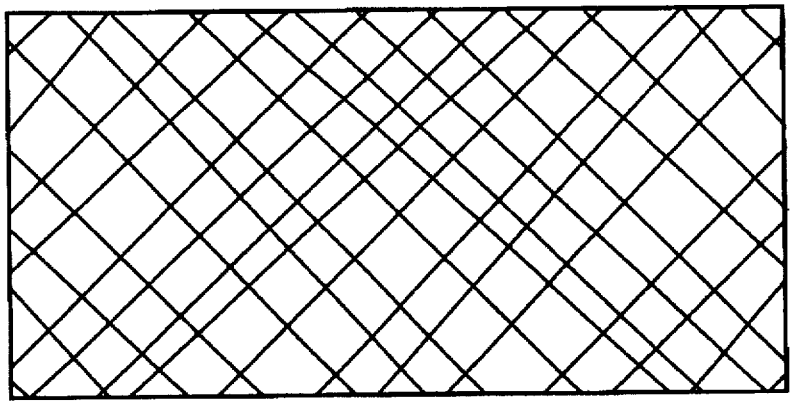
Figure 2:
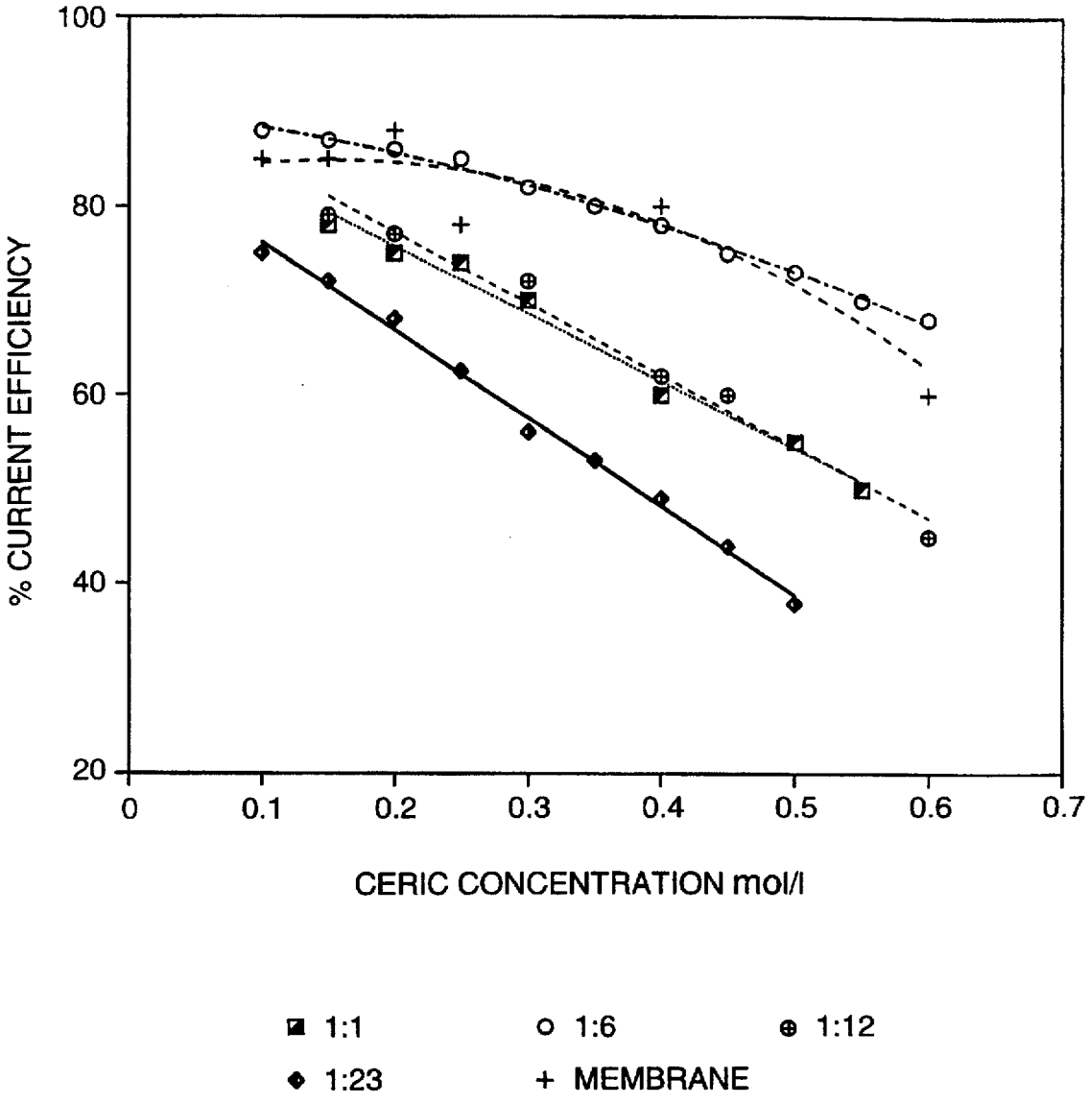
FIG. 2 is a graph of current efficiencies of electrodes having different active to total electrode surface area ratios.

A series of cathodes, with patterns as shown in FIGS. 1*a* and 1*b*, were prepared with active areas to total area of the cathodes to anode in the ratios 1:1, 1:6, 1:12 and 1:23 respectively. The electrodes were fitted into a cell with a standard sized anode and used to regenerate cerous methane sulfonic acid to ceric methane sulfonic acid. The concentration of ceric ion compared to current efficiency was plotted. The results are depicted in FIG. 2. The ratio 1:6 gave the best result, that is, the highest current efficiencies at the highest concentrations. In other experiments it had been determined that ratios of less than 1:2 were inferior and that ratios greater than 1:12 are inferior and have the added disadvantage of creating higher cell voltages.

The result indicates that for ceric regeneration process in methanesulfonic acid the optimum anode cathode ratios are in the region of 1:2–1:6. These numbers will vary depending upon the particular redox or oxidation/reduction reaction involving reversible ions or species. What is surprising is the simplicity of the strategy and significant effect it has on providing high current efficiencies in an undivided electrochemical reactor.

Example 2

This experiment is designed to illustrate known technology using a typical divided cell. A divided electrochemical cell (ICI's FMOI cell which can be obtained from ICI C&P, Runcorn, England) consisting of a cathode made from Hastalloy®C, and an anode made of EBONEX® ceramic coated with platinum was constructed. The two compartments of the divided cell were separated by a NAFION® cation exchange membrane. The analyte and catholyte solutions of cerous methane sulfonate (1.0M) in methanesulfonic acid were circulated through the electrochemical cell while a constant current of 12.8 amps (2000 A/m$^2$) was applied to the cell. The smoothed dc electrical power was provided by a regulated power supply at constant current. The voltage was allowed to fluctuate depending on the temperature and acid concentration in the electrolytes. During the experiment, periodic samples of analyte were tested for increasing ceric content using appropriate redox reagents. After a period of 3 hours, the electrolysis was terminated. The ceric concentration had reached 0.648 molar. Calculated Faradaic efficiency for the reaction was found to be 72%. These results are representative of the results achieved using standard divided cell technology.

Example 3

In this experiment, the same divided cell was employed as in Example 2. However, for this example, the current density employed was doubled to 4000 A/m$^2$. After 1.5 hours of electrolysis (after the same number of coulombs had been applied as in Example 2), the concentration of ceric ion was found to be 0.639 molar where the Faradaic efficiency was calculated to be 65%.

Example 4

In this example, a single compartment electrochemical cell was used along with a bipolar ceramic electrode (EBONEX® brand) with a patterned cathode surface. The cathode surface was formed by first coating the cathode surface with a DuPont soluble PTFE polymer dissolved in perfluorether FC75 supplied by 3M company. The polymer coating produced was removed by scraping away the cathode surface in a grid pattern (as in FIG. 1*a*) to yield an active area to total cathode surface area of 1:23. The cell was fed with two independent flow circuits, feeding cell one and two, to eliminate bypass currents from the calculation of efficiency. To this cell was added a solution of cerous methane sulfonate (1.0M) in methanesulfonic acid. The reaction solution was circulated through the electrochemical cell. After two hours of operation at 2000 A/m$^2$, the concentration of ceric was 0.566 molar. The Faradaic efficiency was calculated to be 65%.

Example 5

In this example, the same cell as used as in Example 4. However, the patterned cathode face of the bipolar electrode was modified to have an exposed area to total cathode surface area ratio of 1:12. The electrolysis was carried out under otherwise identical conditions. After 3 hours, the ceric concentration was 0.639 molar with a Faradaic efficiency of 66%.

Example 6

In this example, the same cell was used as in Examples 4 and 5. However, the patterned cathode face was again modified, this time to have an electrochemically active to inactive area ratio of 1:6. The electrolysis was carried out under otherwise identical conditions. After 3 hours the ceric content was 0.594 molar with a Faradaic efficiency calculated at 73%.

Example 7

In this example, the same cell was used as in Examples 4–6. However, the patterned cathode face was again modified, this time to have an active area to total cathode surface area ratio of 1:1. The electrolysis was carried out under otherwise identical conditions. After three hours, the ceric concentration reached 0.487 molar with a Faradaic efficiency calculated at 57%.

Example 8

In this example, the same bipolar electrode was used as in Example 6. However, for this example, the current density employed was doubled to 4000 A/m$^3$. After 3 hours, the ceric concentration reached 0.594 molar and the Faradaic efficiency reached 73%. The combined results of this example and the results of Example 5 show that the current density employed does not adversely affect the observed Faradaic efficiency.

The results of these examples are summarized in Table 1. Current efficiencies were calculated based on the ratio of the number of coulombs theoretically needed to convert an amount of cerous ion to ceric ion based on Faraday's Law to the actual number of coulombs used in the given example. The result can be expressed in molar concentrations or according to the Faradaic efficiency. Faradaic efficiency allows for changes in the volumes during electrolysis and is the more reliable figure of merit.

TABLE 1

Comparison of the electrochemical cell efficiencies of a membrane cell system to a reduced cathode area system for the electrochemical oxidation of cerous ion to ceric.

| Conditions | Faradaic % | Conc. Cerous methane sulfonate | Significance |
|---|---|---|---|
| Example 2 Membrane at 2000 A/m$^2$ | 72 | 0.648M | Standard performance |
| Example 3 Membrane at 4000 A/m$^2$ | 65 | 0.639M | High current density |
| Example 4 reduced surface cathode at 2000 A/m$^2$ Ratio 1:23 | 65 | 0.566M | Standard performance in undivided cell |
| Example 5 as above with ratio at 1:12 | 66 | 0.639 M | Improvement on example 3 |
| Example 6 as above with ratio at 1:6 | 73 | 0.594M | Further improvement on example 3 |
| Example 7 as above but ratio 1:1 | 57 | 0.487M | Poor result where ratio too high |
| Example 8 as example 4 but at 4000 A/m$^2$ | 73 | 0.594M | Good result at higher current density |

The above examples demonstrate several of the advantages associated with electrodes of the present invention.

The fact that the current efficiencies observed in examples 2 and 3, where a membrane was used, is almost the same as in examples 6 and 8 indicates that the electrodes of the present invention are able to perform the membrane's role in the electrochemical cell, namely, effectively removing the back reaction of the reduction of $Ce^{+4}$ to $Ce^{+3}$. In fact, at high current densities, it is believed that improved hydrodynamics may promote the oxidation of $Ce^{+3}$ to $Ce^{+4}$ at the anode.

The patterned electrodes of the present invention did not disturb the current distribution in the cell. Bipolar electrodes, if they are to be used in bipolar cell stacks, must be able to maintain an even current distribution within the cell. Severe perturbations in the current distribution reduce the overall current efficiency of the bipolar cell stack. Thus, a balance must be struck between the desire to hinder the cathodic or anodic reaction and the need to promote the desired reaction by not creating overly severe perturbations in the current distribution that reduce the overall current efficiency of the cell. The particular pattern and surface area ratio to use in a particular electrochemical system will depend on the diffusion co-efficient, the relative concentrations of the species involved and the cell hydrodynamics. Determination of an optimal pattern and surface ratio may be determined by one of ordinary skill in light of the present teachings.

Use of ceramics to formulate the electrodes, such as the one used to formulate the electrodes used in Examples 2–8, is particularly preferred as it is believed that these ceramic electrodes enable superior even current distributions.

The electrodes of the invention are able to operate at much lower than expected cell voltages. The electrodes of the invention can be used in a wide variety of applications. For example, the electrodes of the invention would be of general utility where a membrane or diaphragm is otherwise required to limit the back reaction. The redox system in examples 2 and 3 can be used without a membrane for recycling titanium, vanadium, manganates, iron, cobalt and other redox reagents. Using a graphite/ceramic bipole, ethylene glycol and other pinacols could also be synthesized in an undivided cell using the electrodes of the present invention.

Other applications for the electrodes of the invention include the manufacture of sodium chlorate without the need to put films of chromate on the cathode surface. The chromate used to inhibit reduction of chlorate and hypochlorite in the cell creates serious recovery problems since chromate is highly toxic even at low concentrations. In addition, high concentration bleach (7%) could be manufactured directly from brine using the electrodes of the present invention.

The electrodes of the invention could also be used in organic waste disposal systems. Current systems that employ membranes frequently become clogged by the oxidized organic materials. Use of the electrodes of the invention would avoid this problem.

We claim:

1. A bipolar electrode, said electrode comprising an electrically conductive substrate, said substrate having opposed electrode faces, one of said faces including a coating forming a pattern of linear ridges of electrocatalytic material on said substrate, wherein the ratio of the area of covered by said electrocatalytic material to the total area of the patterned electrode face is in a range of from 1:2 to 1:50.

2. A bipolar electrode as in claim 1, wherein said ratio is in the range of from 1:6 to 1:12.

3. A bipolar electrode as in claim 1, wherein said substrate comprises a material selected from the group consisting of conductive ceramics, metals, precious metals and metal oxides.

4. A bipolar electrode as in claim 3, wherein said substrate comprises titanium.

5. A bipolar electrode as in claim 3, wherein said substrate comprises niobium.

6. A bipolar electrode as in claim 3, wherein said substrate comprises titanium suboxide of the formula $TiO_x$, where x has a value of from 1.63 to 1.94.

7. A bipolar electrode as in claim 6, wherein said substrate has a thickness of from 10 microns to 3 mm.

8. A bipolar electrode as in claim 1, wherein said pattern comprises crossed linear ridges.

9. A bipolar electrode as in claim 1, wherein said one face has a grid-like pattern.

10. A method for converting $Ce^{+4}$ to $Ce^{+3}$ comprising contacting $Ce^{+4}$ with a bipolar electrode wherein the bipolar electrode comprises an electrically conductive substrate, said substrate having opposed electrode faces, one of said faces including a coating forming a pattern of linear ridges of electrocatalytic material on said substrate, wherein the ratio of the area covered by said electrocatalytic material to the total area of the patterned electrode face is in a range of from 1:2 to 1:50.

11. A method according to claim 10, wherein the ratio is in the range of from 1:6 to 1:12.

12. A method according to claim 10, wherein said substrate comprises electrically conductive ceramics, metals, precious metals and metal oxides.

13. A method according to claim 12, wherein said electrically conductive substrate comprises titanium.

14. A method according to claim 12, wherein said electrically conductive substrate comprises niobium.

15. A method according to claim 12, wherein said electrically conductive substrate comprises titanium suboxide of the formula $TiO_x$, where x has a value of from 1.63 to 1.94.

16. A method according to claim 15, wherein said electrically conductive substrate has a thickness of from 10 microns to 3 mm.

17. A method according to claim 10, wherein said $Ce^{+4}$ is present as ceric methane sulfonate in methanesulfonic acid.

18. A method according to claim 10, wherein said one face has a grid-like pattern.

19. A method according to claim 10, wherein said pattern comprises crossed linear ridges.

20. A bipolar electrode, said electrode comprising an electrically conductive substrate and a nonconductive coating applied to said substrate, said substrate having opposed electrode faces, one of said faces including said coating in the form of a pattern of linear ridges of electrocatalytic material, wherein the ratio of the area of covered by said electrocatalytic material to the total area of the patterned electrode face is in a range of from 1:2 to 1:50.

21. A bipolar electrode as in claim 20, wherein said ratio is in the range of from 1:6 to 1:12.

22. A bipolar electrode as in claim 20, wherein said substrate comprises a material selected from the group consisting of conductive ceramics, metals, precious metals and metal oxides.

23. A bipolar electrode as in claim 22, wherein said substrate comprises titanium.

24. A bipolar electrode as in claim 22, wherein said substrate comprises niobium.

25. A bipolar electrode as in claim 20, wherein said pattern comprises crossed linear ridges.

26. A bipolar electrode as in claim 20, wherein said one face has a grid-like pattern.

27. A bipolar electrode, said electrode comprising an electrically conductive substrate and a coating on said substrate, said substrate having opposed electrode faces, one of said faces including said coating wherein said coating is treated to form of a pattern of linear ridges of electrocatalytic material, wherein the ratio of the area of covered by said electrocatalytic material to the total area of the patterned electrode face is in a range of from 1:2 to 1:50.

28. A bipolar electrode as in claim 27, wherein said ratio is in the range of from 1:6 to 1:12.

29. A bipolar electrode as in claim 27, wherein said substrate comprises a material selected from the group consisting of conductive ceramics, metals, precious metals and metal oxides.

30. A bipolar electrode as in claim 29, wherein said substrate comprises titanium.

31. A bipolar electrode as in claim 29, wherein said substrate comprises niobium.

32. A bipolar electrode as in claim 29, wherein said pattern comprises crossed linear ridges.

33. A bipolar electrode as in claim 29, wherein said one face has a grid-like pattern.

* * * * *